US009252541B2

(12) United States Patent
Kumamoto et al.

(10) Patent No.: US 9,252,541 B2
(45) Date of Patent: Feb. 2, 2016

(54) CONNECTOR

(75) Inventors: Tadashi Kumamoto, Shinagawa (JP); Takeshi Okuyama, Shinagawa (JP); Kazuhiro Mizukami, Shinagawa (JP); Toshihiro Kusagaya, Shinagawa (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 69 days.

(21) Appl. No.: 13/344,212

(22) Filed: Jan. 5, 2012

(65) Prior Publication Data

US 2012/0178292 A1 Jul. 12, 2012

(30) Foreign Application Priority Data

Jan. 6, 2011 (JP) ..... 2011-001187

(51) Int. Cl.
*H01R 13/64* (2006.01)
*H01R 13/6581* (2011.01)

(52) U.S. Cl.
CPC ..... *H01R 13/6581* (2013.01)

(58) Field of Classification Search
CPC ..... H01R 13/6581; H01R 13/6477
USPC ..... 439/606, 608, 88, 961, 607.01–607.16, 439/607.05–607.15
See application file for complete search history.

(56) References Cited

U.S. PATENT DOCUMENTS 5,362,257 A * 11/1994 Neal ..... H01R 13/6467 439/676
5,453,016 A * 9/1995 Clark et al. ..... 439/79
5,660,551 A * 8/1997 Sakurai ..... 439/108
6,217,352 B1 * 4/2001 Oliphant ..... H01R 24/62 439/131
6,517,360 B1 * 2/2003 Cohen ..... 439/65
7,118,391 B2 * 10/2006 Minich ..... H01R 29/00 439/79
7,186,135 B2 * 3/2007 Maegawa et al. ..... 439/490
7,390,200 B2 * 6/2008 Shuey ..... H01R 23/6873 439/79
7,462,924 B2 * 12/2008 Shuey ..... H01R 13/6471 257/666
7,585,186 B2 * 9/2009 McAlonis ..... H01R 13/514 439/607.05
7,713,088 B2 * 5/2010 Sercu ..... H01R 13/65807 439/607.1
7,722,401 B2 * 5/2010 Kirk ..... H01R 13/514 439/108
7,758,375 B2 * 7/2010 Moriyama et al. ..... 439/497
7,789,705 B2 * 9/2010 Morgan ..... H01R 13/6477 439/607.05
7,794,278 B2 * 9/2010 Cohen ..... H01R 13/65807 439/108

(Continued)

FOREIGN PATENT DOCUMENTS

JP 2003-515896 5/2003
JP 2004-87348 3/2004

(Continued)

OTHER PUBLICATIONS

Japanese Office Action mailed Mar. 11, 2014 in corresponding Japanese Application No. 2011-001187.

*Primary Examiner* — Ross Gushi
(74) *Attorney, Agent, or Firm* — Staas & Halsey LLP

(57) ABSTRACT

A connector 10 which comprises a plurality of signal contacts 11, each of which is provided with two aligned first connecting parts 12*a* at one end and two aligned second connecting parts 12*b* at the other end and which form balanced transmission lines, further comprises a first holding member 13 which holds the first connecting parts 12*a* of the plurality of signal contacts 11 and a second holding member 14 which holds the second connecting parts 12*b*, intermediate parts of the plurality of signal contacts 11 between the first holding member 13 and the second holding member 14 being exposed to the air.

4 Claims, 8 Drawing Sheets

(56) References Cited

U.S. PATENT DOCUMENTS 7,927,152 B2 * 4/2011 Pepe ..... H01R 24/64 439/676
7,931,474 B2 * 4/2011 Laurx ..... H01R 12/737 439/607.07
7,963,806 B1 * 6/2011 Scott Kline et al. ..... 439/660
7,967,644 B2 * 6/2011 Pepe ..... H01R 13/02 439/676
7,976,318 B2 * 7/2011 Fedder ..... H01R 13/514 439/607.11
8,231,415 B2 * 7/2012 Johnescu ..... H01R 13/6477 439/701
8,287,316 B2 * 10/2012 Pepe ..... H01R 13/02 439/676
8,366,485 B2 * 2/2013 Johnescu ..... H01R 13/514 439/108
8,382,522 B2 * 2/2013 Glover ..... H01R 12/585 439/607.08
8,425,261 B2 * 4/2013 Pepe ..... H01R 24/64 439/676
8,496,501 B2 * 7/2013 Pepe ..... H01R 13/02 439/676
8,500,496 B2 * 8/2013 Bopp ..... H01R 13/6658 439/676
8,632,368 B2 * 1/2014 Pepe ..... H01R 13/02 439/676
8,715,003 B2 * 5/2014 Buck ..... H01R 12/73 439/607.07
8,814,595 B2 * 8/2014 Cohen ..... H01R 13/6461 439/607.07
8,845,364 B2 * 9/2014 Wanha ..... H01R 13/516 439/607.07
8,864,516 B2 * 10/2014 Herring ..... H05K 7/1451 361/729
2004/0043661 A1 3/2004 Okada et al.
2004/0224559 A1 * 11/2004 Nelson ..... H01R 13/514 439/607.05
2005/0009402 A1 * 1/2005 Chien ..... H01R 13/514 439/607.13
2005/0260883 A1 * 11/2005 Aihara et al. ..... 439/475
2007/0004282 A1 * 1/2007 Cohen et al. ..... 439/608
2007/0021003 A1 * 1/2007 Laurx ..... H01R 13/514 439/607.05
2007/0021004 A1 * 1/2007 Laurx ..... H01R 13/514 439/607.05
2007/0155239 A1 * 7/2007 Nakada ..... 439/607
2007/0293063 A1 * 12/2007 Droesbeke ..... H01R 13/65807 439/108
2008/0064231 A1 * 3/2008 Schell ..... H01R 12/737 439/65
2008/0203547 A1 * 8/2008 Minich ..... H01R 12/712 257/669
2008/0246555 A1 * 10/2008 Kirk ..... H01R 13/514 333/125
2008/0248660 A1 * 10/2008 Kirk ..... H01R 13/514 439/68
2008/0316729 A1 * 12/2008 Rothermel ..... H01R 23/688 361/813
2009/0011643 A1 * 1/2009 Amleshi ..... H01R 13/514 439/607.05
2009/0011644 A1 * 1/2009 Amleshi ..... H01R 13/514 439/607.05
2009/0011645 A1 * 1/2009 Laurx ..... H01R 13/6471 439/607.05
2009/0017681 A1 * 1/2009 Amleshi et al. ..... 439/608
2009/0017682 A1 * 1/2009 Amleshi ..... H01R 13/6471 439/607.05
2009/0068899 A1 * 3/2009 Smith ..... H01R 12/712 439/660
2009/0291593 A1 * 11/2009 Atkinson ..... H01R 13/6471 439/607.06
2009/0298308 A1 * 12/2009 Kenny et al. ..... 439/65
2010/0022129 A1 * 1/2010 Morgan ..... H01R 13/6477 439/607.05
2010/0055933 A1 * 3/2010 Laurx ..... H01R 12/737 439/65
2010/0197169 A1 * 8/2010 Amleshi ..... H01R 12/585 439/626
2010/0197170 A1 * 8/2010 Amleshi ..... H01R 12/585 439/626
2010/0221956 A1 * 9/2010 Pepe et al. ..... 439/676
2010/0240233 A1 * 9/2010 Johnescu ..... H01R 13/514 439/108
2010/0291803 A1 * 11/2010 Kirk ..... H01R 23/688 439/660
2011/0009011 A1 * 1/2011 Johnescu ..... H01R 13/6477 439/701
2011/0159744 A1 * 6/2011 Buck ..... H01R 12/73 439/660
2011/0230095 A1 * 9/2011 Atkinson ..... H01R 13/6471 439/607.06
2011/0256763 A1 * 10/2011 De Geest ..... H01R 12/724 439/607.01
2011/0318962 A1 * 12/2011 De Geest ..... H05K 1/0231 439/607.01
2012/0015533 A1 * 1/2012 Fogg ..... H01R 12/724 439/95
2012/0015563 A1 * 1/2012 Szczesny ..... H01R 13/6585 439/682
2012/0030146 A1 * 2/2012 Crighton ..... H01R 12/737 705/500
2012/0178292 A1 * 7/2012 Kumamoto ..... H01R 13/6581 439/607.01
2012/0202363 A1 * 8/2012 McNamara ..... H01R 13/6461 439/74
2012/0202387 A1 * 8/2012 McNamara ..... H01R 13/6461 439/629
2012/0214344 A1 * 8/2012 Cohen et al. ..... 439/607.08
2013/0029536 A1 * 1/2013 Bopp ..... H01R 13/6658 439/676
2013/0109232 A1 * 5/2013 Paniaqua ..... H01R 13/6581 439/607.07
2013/0217263 A1 * 8/2013 Pan ..... H01R 13/6474 439/607.07
2014/0099829 A1 * 4/2014 Laurx ..... H01R 12/737 439/628
2014/0242844 A1 * 8/2014 Wanha ..... H01R 13/516 439/626
2014/0273627 A1 * 9/2014 Cartier, Jr. ..... H01R 13/658 439/607.11
2014/0273663 A1 * 9/2014 Cartier, Jr. ..... H01R 43/16 439/692
2014/0302718 A1 * 10/2014 Gailus ..... H01R 13/66 439/620.21

FOREIGN PATENT DOCUMENTS

JP 2005-518067 6/2005
WO WO 01/39332 A1 5/2001
WO WO 03/043138 A1 5/2003

* cited by examiner

CONNECTOR

CROSS-REFERENCE TO RELATED APPLICATIONS

This application is based upon and claims the benefit of priority from prior Japanese Patent Application No. 2011-001187 filed on Jan. 6, 2011, the entire contents of which are incorporated herein by reference.

BACKGROUND OF THE INVENTION

1. Field of the Invention

The present invention relates to a connector, more particularly relates to a connector which establishes electrical connections.

2. Description of the Related Art

Known in the art is a connector device which has a plurality of pairs of signal contacts which form balanced transmission lines which transmit differential signals inverted in phase from each other, wherein a shield structure which can efficiently reduce the differential signals becoming noise with respect to other signals, that is, crosstalk, can be realized by a smaller number of parts (see Japanese Patent Publication (A) No. 2004-087348).

SUMMARY OF INVENTION

In this regard, as shown in Japanese Patent Publication (A) No. 2004-087348, FIG. 6, sometimes the transmission lines of a pair of signal contacts arranged in parallel are bent, whereby the transmission line of the outside signal contact becomes longer than the transmission line of the inside signal contact. As a result, a signal which is transmitted by an outside signal contact ends up in the final analysis being transmitted delayed from the signal transmitted by an inside signal contact.

The present invention, in one aspect, provides a connector which has a plurality of signal contacts which have different transmission line lengths, wherein signals are transmitted without being delayed compared with other signal contacts.

Further, the present invention, in one aspect, provides a connector which makes the transmission loss decrease.

In a first aspect of the present invention, there is provided a connector which comprises a plurality of signal contacts, each of which is provided with two aligned first connecting parts at one end and two aligned second connecting parts at the other end and which form balanced transmission lines, wherein the connector further comprises a first holding member which holds the first connecting parts of the plurality of signal contacts and a second holding member which holds the second connecting parts, intermediate parts of the plurality of signal contacts between the first holding member and the second holding member being exposed to the air.

That is, according to this aspect, since the intermediate parts of the signal contacts are exposed to the air, compared with signal contacts which are covered by insulators as seen in ordinary connectors, the contacts are covered by a substance with a low dielectric tangent, that is, the air, so the transmission loss can be made to decrease more.

Further, in a second aspect of the present invention, there is provided a connector which further comprises at least one connecting and fastening member which connects and fastens the intermediate parts of the plurality of signal contacts while separating them from each other.

That is, according to this aspect, by connecting and fastening the intermediate parts of the signal contacts while separating them from each other, the strength against external force applied to the signal contacts is increased.

Further, in a third aspect of the present invention, there is provided a connector wherein the first holding member, the second holding member, and the connecting and fastening member are formed together with the plurality of signal contacts by insert molding.

That is, according to this aspect, by using insert molding, there is the advantage that production of the connector becomes easier.

Further, in a fourth aspect of the present invention, there is provided a connector further comprising a ground contact which comprises a shield body which is arranged in parallel with the plurality of signal contacts and shield members which are provided at an end edge of the shield body, pass through the first holding member or second holding member, and are arranged between the connecting parts of the pairs of signal contacts in the plurality of signal contacts.

That is, according to this aspect, by further providing the ground contact, it is possible to reduce crosstalk. Further, since the shield members are arranged through the shield body which is arranged in parallel with the signal contacts, mounting also becomes easy.

Further, in a fifth aspect of the present invention, there is provided a connector which is provided with a plurality of signal contacts which are supported by contact support members while being bent to give different transmission line lengths, wherein a relative permittivity of the contact support members around the signal contacts with short transmission line lengths is higher than a relative permittivity of the contact support members around the signal contacts with long transmission line lengths.

Further, in a sixth aspect of the present invention, there is provided a connector wherein at least parts of the surroundings of the signal contacts with short transmission line lengths are covered by the contact support members with a relative permittivity higher than the relative permittivity of the surroundings of the signal contacts with long transmission line lengths.

Further, in a seventh aspect of the present invention, there is provided a connector wherein at least parts of the surroundings of the signal contacts with long transmission line lengths are covered by the contact support members with a relative permittivity lower than the relative permittivity of the surroundings of the signal contacts with short transmission line lengths.

Further, in an eighth aspect of the present invention, there is provided a connector wherein parts of the contact support members which support the signal contacts with long transmission line lengths are provided with recesses and are exposed to the air.

Further, in a ninth aspect of the present invention, there is provided a connector wherein the plurality of signal contacts are at least one pair of signal contacts which form a balanced transmission line.

That is, according to the fifth to ninth aspects of the present invention, by adjusting the relative permittivity of the substance at the surroundings of the signal contacts, it becomes possible to change the transmission speed of the signals transmitted by the signal contacts and becomes possible to absorb delay of signals due to differences in transmission line lengths between signal contacts which unavoidably arise due to design factors.

Below, the present invention will be able to be understood more clearly from the attached drawings and the description of the preferred embodiments of the present invention.

BRIEF DESCRIPTION OF THE DRAWINGS

FIGS. 5A and 5B show a plug connector according to still another aspect of the present invention, in which FIG. 5A is a front view and FIG. 5B is a side cross-sectional view.

DESCRIPTION OF THE PREFERRED EMBODIMENTS

Figure 1:
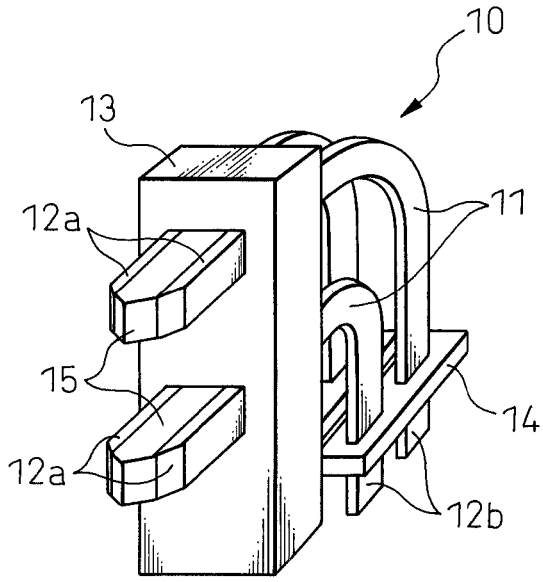
FIG. 1 is a perspective view of a plug connector according to one aspect of the present invention.

Below, embodiments of the present invention will be explained in detail while referring to the drawings. Throughout the figures, corresponding component elements are assigned common reference notations. Further, the connectors which are explained below by several aspects are used as connectors for establishing electrical connection for balanced transmission (that is, differential transmission) etc. in for example computers, servers, exchanges, routers, etc. In the aspects of the present invention which are shown below, the explanations are given with reference to the example of a connector for balanced transmission.

FIG. 1 is a perspective view of a plug connector 10 according to one aspect of the present invention. The plug connector 10 is a right angle type connector which has a plurality of pairs of signal contacts 11 which transmit differential signals inverted in phase from each other and form curved balanced transmission lines. In general, a right angle type connector is used for vertically electrically connecting a circuit board called a "mother board" and a circuit board called a "daughter card" in a server etc. Therefore, the signal contacts 11 are provided with two aligned pin-shaped connecting parts 12*a* and parts 12*b* at the two ends. The connecting parts 12*a* at one end are held by a first holding member 13 comprised of an insulator to thereby form a connection surface and are connected to connecting parts of a straight type jack connector which are arranged at a not shown facing connection surface. Further, the connecting parts 12*b* at the other ends of the signal contacts 11 are held by a second holding member 14 comprised of an insulator to thereby form a connection surface which is perpendicular to the connection surface which is formed by the first holding member 13 and are connected to connecting parts of a circuit board etc. which are arranged at a not shown facing connection surface.

Note that, between the connecting parts 12*a* of each pair of parts to be connected to the jack connector, a reinforcing member 15 made of an insulator is inserted so that the elasticity of the spring-type connecting part of the jack connector side can be withstood at the time of connection.

The signal contacts 11 are held while separated from each other by the first holding member 13 and second holding member 14, so the surfaces of the intermediate parts of the signal contacts 11 between the first holding member 13 and the second holding member 14 are exposed. Therefore, the intermediate parts are covered by a substance with a lower dielectric tangent compared with signal contacts which are covered by an insulator such as seen in ordinary connectors, that is, by the air, so the transmission loss can be made to decrease more.

The plug connector 10 is formed by first forming the pairs of signal contacts 11, arranging them separated from each other, then forming the first holding member 13 and second holding member 14 by insert molding. Due to this, the signal contacts 11 can be easily attached to the first holding member 13 and the second holding member 14.

Figure 2:
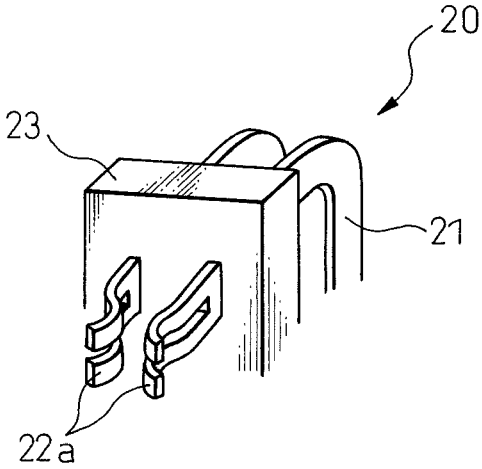
FIG. 2 is a partial perspective view of a jack connector according to one aspect of the present invention.

FIG. 2 is a partial perspective view of a jack connector 20 according to one aspect of the present invention. The jack connector 20, in the same way as the plug connector 10 shown in FIG. 1, is a right angle type connector which has a plurality of pairs of signal contacts 21 which transmit differential signals and form curved balanced transmission lines. The jack connector 20 differs from the plug connector 10 shown in FIG. 1 only on the point that the connecting parts 22*a* of the signal contacts 21 are structured not as pin shapes, but as spring shapes. Therefore, the connecting parts 22*a* of the signal contacts 21 are held by the first holding member 23 comprised of the insulator to form a connection surface and are connected to the connecting parts of the straight type plug connector which are arranged at a not shown facing connection surface. The jack connector 20 is also formed by insert molding in the same way as the plug connector 10 shown in FIG. 1.

The surfaces of the intermediate parts of the signal contacts 21 are exposed in the same way as the plug connector 10 shown in FIG. 1. Therefore, the intermediate parts are covered by a substance with a lower dielectric tangent compared with signal contacts which are covered by an insulator such as seen in ordinary connectors, that is, by the air, so the transmission loss can be made to decrease more.

Figure 3:
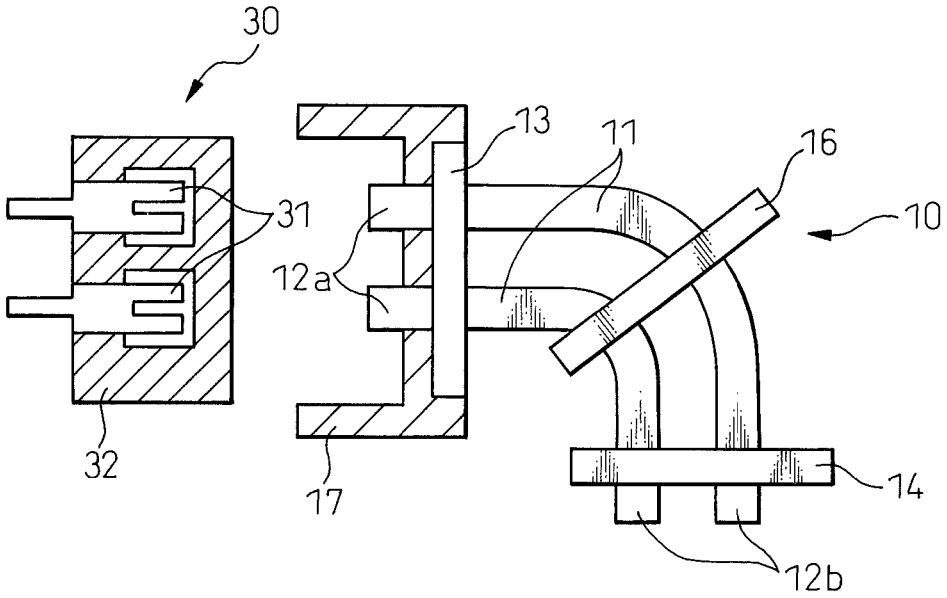
FIG. 3 is a side cross-sectional view of a plug connector according to another aspect of the present invention.

FIG. 3 is a side cross-sectional view of a plug connector 10 according to another aspect of the present invention. The plug connector 10 shown in FIG. 1 is further provided with a connecting and fastening member 16. The connecting and fastening member 16 is an insulator and is formed by insert molding in the same way as the first holding member 13 and second holding member 14. The connecting and fastening member 16 connects and fastens the intermediate parts of the signal contacts 11 between the first holding member 13 and the second holding member 14 while separating them from each other, so the strength against external force applied to the signal contacts 11 is increased compared with the case of no connecting and fastening member 16.

Note that, in FIG. 3, at the left side of the plug connector 10, an outline of the straight type jack connector 30 to be connected to is shown. The jack connector 30 has spring-shaped connecting parts 31 and further has a housing 32 which fits into an engagement guide member 17 of the plug connector 10.

Figure 4:
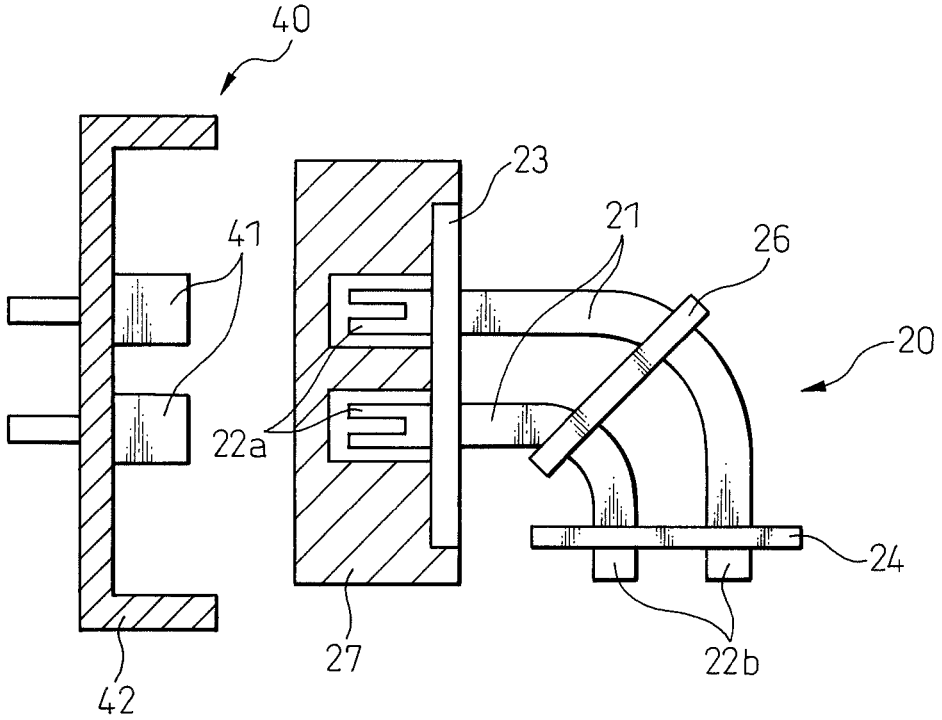
FIG. 4 is a side cross-sectional view of a jack connector according to another aspect of the present invention.

FIG. 4 is a side cross-sectional view of a jack connector 20 according to another aspect of the present invention. This comprises the jack connector 20 shown in FIG. 2 further provided with a connecting and fastening member 26. The connecting and fastening member 26 is an insulator and is formed by insert molding in the same way as the first holding member 23 and the second holding member 24. The connecting and fastening member 26 connects and fastens the intermediate parts of the signal contacts 21 between the first holding member 23 and the second holding member 24 while separating them from each other, so the strength against external force applied to the signal contacts 21 is increased compared with the case of no connecting and fastening member 26.

Note that, in FIG. 4, at the left side of the jack connector 20, an outline of the straight type plug connector 40 to be connected to is shown. The plug connector 40 has pin-shaped connecting parts 41 and further has an engagement guide member 42 which fits over the housing 27 of the jack connector 20.

Further, one or three or more of the connecting and fastening members 16 or connecting and fastening members 26 shown in FIG. 3 or FIG. 4 may also be provided. Furthermore, the surfaces of the intermediate parts of the signal contacts which are not covered by the connecting and fastening members are exposed, so as explained above, the transmission loss can be made to decrease more.

Figure 5A:
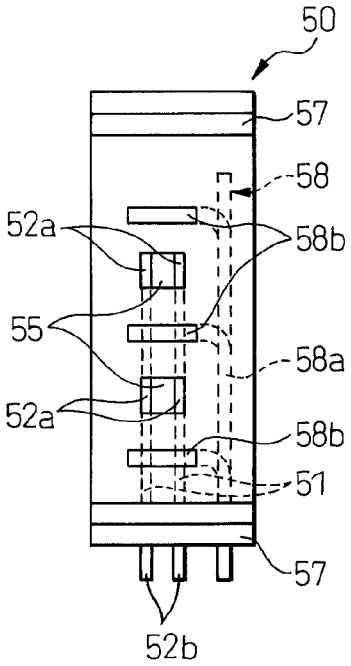
Figure 5B:
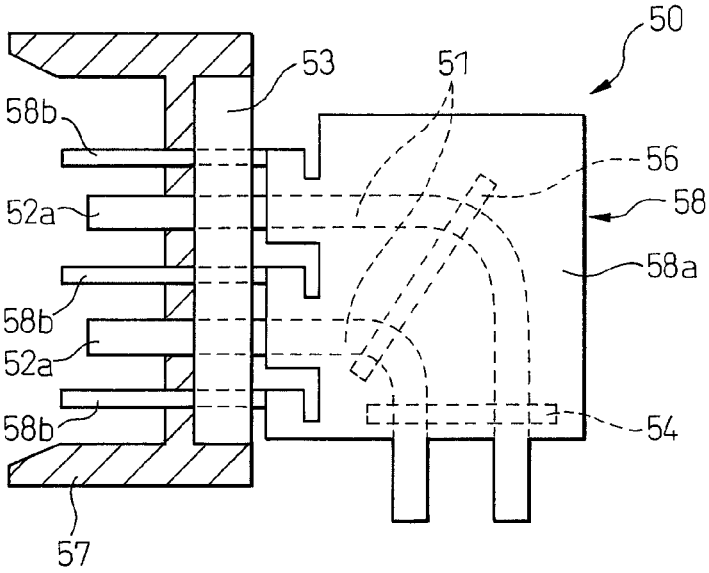

FIGS. 5A and 5B show a plug connector according to still another aspect of the present invention, in which FIG. 5A is a front view and FIG. 5B is a side cross-sectional view. The plug connector 50 is identical in basic configuration from the plug connector 10 shown in FIG. 1 or FIG. 3. That is, the plug connector 50 is a right angle type connector which has a plurality of pairs of signal contacts 51 which transmit differential signals and form curved balanced transmission lines. Therefore, the connecting parts 52*a* at first ends of the signal contacts 51 are held by the first holding member 53 comprised of an insulator to form a connection surface and are connected to connecting parts of a straight type plug connector which are arranged at a not shown facing connection surface. Further, the connecting parts 52*b* of the other end of the signal contacts 51 are held by a second holding member 54 comprised of an insulator, form a connection surface perpendicular to the connection surface formed by the first holding member 53, and are connected to connecting parts of a circuit board etc. arranged at a not shown facing connection surface.

Further, the plug connector 50 shown in FIGS. 5A and 5B is further provided with a connecting and fastening member 56. The connecting and fastening member 56 is an insulator and is formed by insert molding in the same way as the first holding member 53 and the second holding member 54. The connecting and fastening member 56 connects and fastens the intermediate parts of the signal contacts 51 between the first holding member 53 and the second holding member 54 while separating them from each other, so the strength against external force applied to the signal contacts 51 is increased compared with the case of no connecting and fastening member 56.

Furthermore, the plug connector 50 shown in FIGS. 5A and 5B is provided with a ground contact 58. The ground contact 58 has a shield body 58*a* which is arranged in parallel with the signal contacts 51 and has shield members 58*b* which are provided at an end edge of the shield body 58*a*, pass through the first holding member 53 and engagement guide member 57, and are arranged between the connecting parts 52*a* of the pairs of signal contacts 51 of the two pairs of signal contacts 51 shown in FIGS. 5A and 5B. By arranging the shield members 58*b* between the connecting parts 52*a* of the pairs of signal contacts 51, it becomes possible to make the crosstalk decrease. Further, the shield members 58*b* can further make the crosstalk decrease by arranging them equally at the tops and bottoms of the connecting parts 52*a* in FIGS. 5A and 5B.

Figure 6:
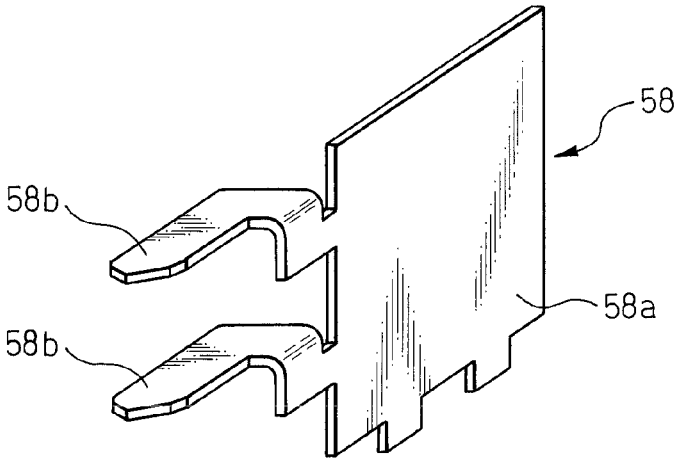
FIG. 6 is a perspective view of a ground contact.

FIG. 6 is a perspective view of a ground contact 58. The ground contact 58 is a conductive plate-shaped member. First, a stamping process etc. is used to form the shield body 58*a* and the shield members 58*b* on the same plane. After this, parts of the shield members 58*b* which stick out from the end edges of the shield body 58*a* are bent 90 degrees to obtain the ground contact 58 such as shown in FIG. 6. For the shape of the shield members 58*b*, any shape can be employed within a range enabling the objective of reducing the crosstalk to be achieved. Note that, the ground contact 58 shown in FIG. 6 has two shield members 58*b* for convenience of illustration, but what is actually provided in FIGS. 5A and 5B is one which has three shield members 58*b*.

If explaining the attachment of the ground contact 58, first, in the same way as the plug connector 10 shown in FIG. 1 etc., the members other than the ground contact 58 are formed by insert molding. After that, the separately worked ground contact 58 is engaged while inserting the shield members 58*b* into slits provide in the first holding member 53 and engagement guide member 57 and placed in parallel with the signal contacts 51 to complete the assembly.

According to this assembly method, the ground contact 58 need only be produced at a separate process from the other parts of the plug connector 50, so there are the advantages that insert molding can be made simpler and productivity can be improved. Further, the ground contact 58 can also be applied to another aspects, for example, can also be applied in the aspect shown in FIG. 1 not having any connecting and fastening members.

Further, the connecting and fastening member 56 shown in FIG. 5 may be provided at one location or three or more locations as well. Furthermore, the surface of the intermediate part of the signal contacts 51 which is not covered by the connecting and fastening member 56 is exposed, so as explained above, it becomes possible to make the transmission loss decrease more.

Note that, there were two pairs of signal contacts in the aspect of the present invention explained above, but only naturally there may be a single pair or three or more pairs as well. Further, in the aspect of the present invention shown in FIG. 5, the necessary number of shield members 58*b* is the number of pairs of the signal contacts 51 plus 1.

In the above aspects of the present invention, the pairs of signal contacts for transmitting the differential signals were of the same transmission line lengths. Below, a connector which has a plurality of signal contacts with different transmission line lengths wherein signals can be transmitted without delay compared with other signal contacts will be explained.

Figure 7:
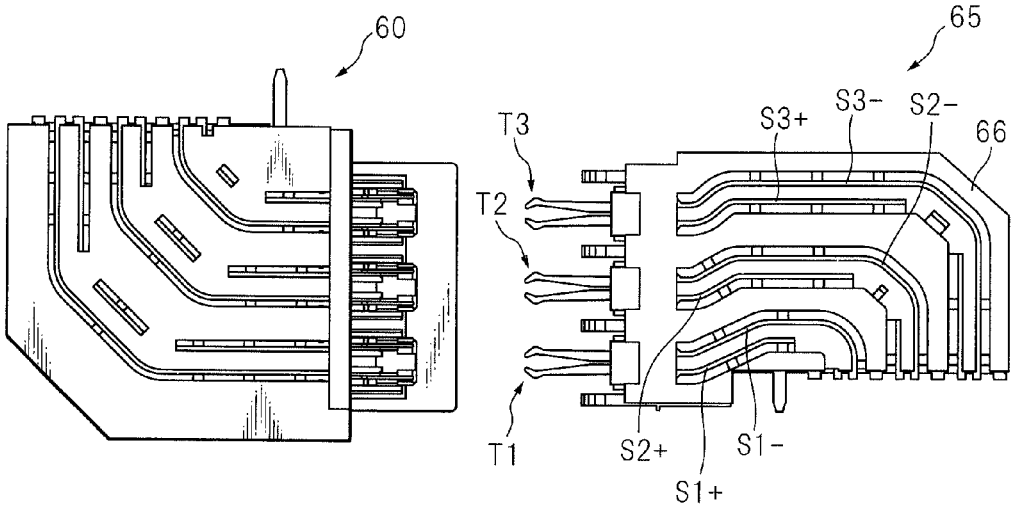
FIG. 7 is a side view of a jack connector and a plug connector.

FIG. 7 is a side view of a plug connector 60 and a jack connector 65 which is connected to the same. The plug connector 60 and jack connector 65 are right angle type connectors which have pluralities of pairs of signal contacts which transmit differential signals inverted in phase from each other and form curved balanced transmission lines. The plug connector 60 and jack connector 65 only differ in shapes of the connecting parts. The rest of the shapes are the generally the same, so in the aspects of the present invention shown below, the explanation will be given with reference to the jack connector 65 as an example.

The jack connector 65 has a body 66 made of an insulator. The body 66 is formed with a plurality of grooves separated by a plurality of partitions. The grooves at the two sides of each partition are provided with a pair of signal contacts and are terminated at the connecting parts. That is, pairs of differential signals of the signal contacts S1+ and S1−, S2+ and S2−, and S3+ and S3− are formed and are connected to the corresponding connecting parts T1, T2, and T3.

As clear from FIG. 7 as well, the signal contacts are bent to the left in FIG. 7, so the signal contact S1− is longer in transmission line length than S1+, the signal contact S2− is longer than S2+, and the signal contact S3− is longer than S3+, that is, the outer signal contacts of the bent signal contacts are longer. Therefore, if left this way, a signal ends up being delayed by exactly the amount of the difference of the lengths in each pair of signal contacts divided by the transmission speed of the signal.

In this regard, the transmission speed of a signal which is transmitted by a signal contact, that is, the phase speed Vp, is expressed by the following formula (1).

$$Vp=c/(\mu s\times\in s)^{1/2} \quad (1)$$

Here, "c" is light speed (m/s) in a vacuum, μs is the relative magnetic permeability, and ∈s is the relative permittivity.

Therefore, the connector structure of a right angle type connector which by adjusts the ∈s, that is, the relative permittivity of the substance around the signal contacts, to transmit a signal with the longer transmission line length without delay will be explained.

Figure 8:
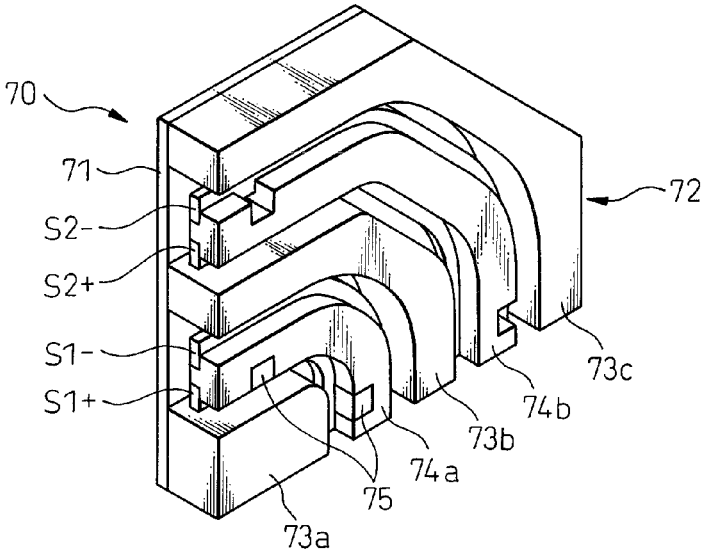
FIG. 8 is a partial perspective view of a connector structure according to one aspect of the present invention.
Figure 9:
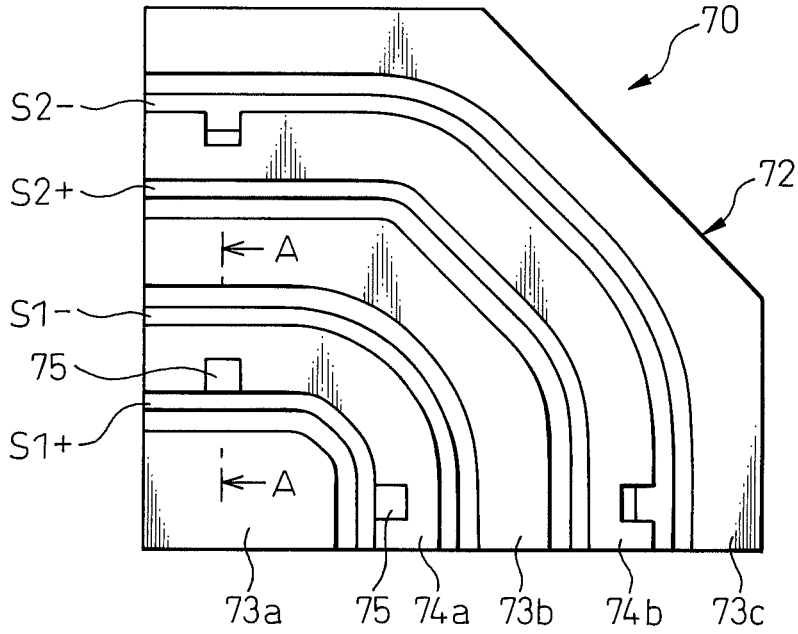
FIG. 9 is a partial side view of a connector structure shown in FIG. 8.
Figure 10:
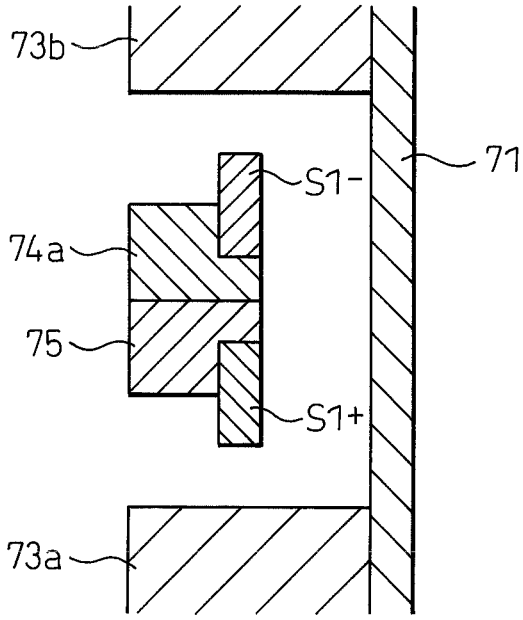
FIG. 10 is a partial enlarged cross-sectional view along the line A-A of FIG. 9 of the connector structure shown in FIG. 8.

FIG. 8 is a partial perspective view of a connector structure 70 according to one aspect of the present invention, FIG. 9 is a partial side view of a connector structure 70 shown in FIG. 8, and FIG. 10 is a partial enlarged cross-sectional view along the line A-A of FIG. 9 of the connector structure 70 shown in FIG. 8. The connector structure 70 has an insulator board 71 and an insulator body 72. The body 72 has partitions 73*a*, 73*b*, and 73*c* which are attached to the board 71 and has contact support members 74*a* and 74*b*. The contact support members 74*a* and 74*b* are attached to the partitions by not shown parts and support the pairs of signal contacts S1+ and S1− and S2+ and S2− so that they do not contact the board 71. Further, the signal contacts S1+ and S1− and S2+ and S2− are separated by the contact support members 74*a* and 74*b* so that the signal contacts of each pair do not contact each other. Note that, the signal contacts S1+ and S1− and S2+ and S2− are exposed at parts other than those contacting the contact support members 74*a* and 74*b*.

In the present aspect, parts of contact support member 74*a* are cut away and filled instead with transmission speed delay members 75 at the side facing the signal contact, of the pair of signal contacts S1+ and S1− separated by the contact support member 74*a*, with the shorter transmission line length, that is, the signal contact S1+ side. The relative permittivity of the transmission speed delay members 75 is larger than the relative permittivity of the material of the insulator of the contact support member 74*a*. Therefore, according to the above formula (1), by making the relative permittivity larger, the speed Vp becomes smaller. As a result, it becomes possible to adjust a signal to be transmitted simultaneously with the signal contact S1− side with the long transmission line length.

Note that, the suitable range and size are determined by experiments or calculations in accordance with the relatively permittivity of the transmission speed delay member 75. The recesses which are provided at the contact support member 74*b* will be explained in the next aspect.

Figure 11:
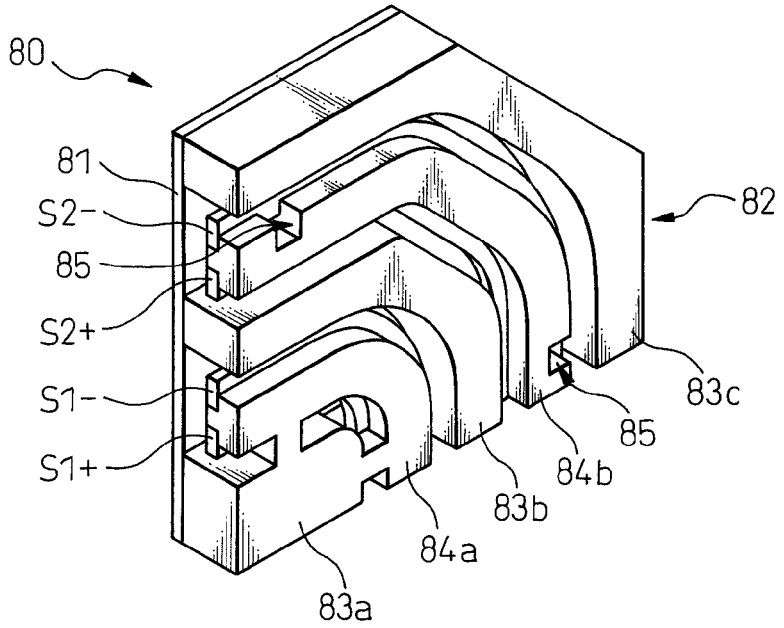
FIG. 11 is a partial perspective view of a connector structure according to another aspect of the present invention.
Figure 12:
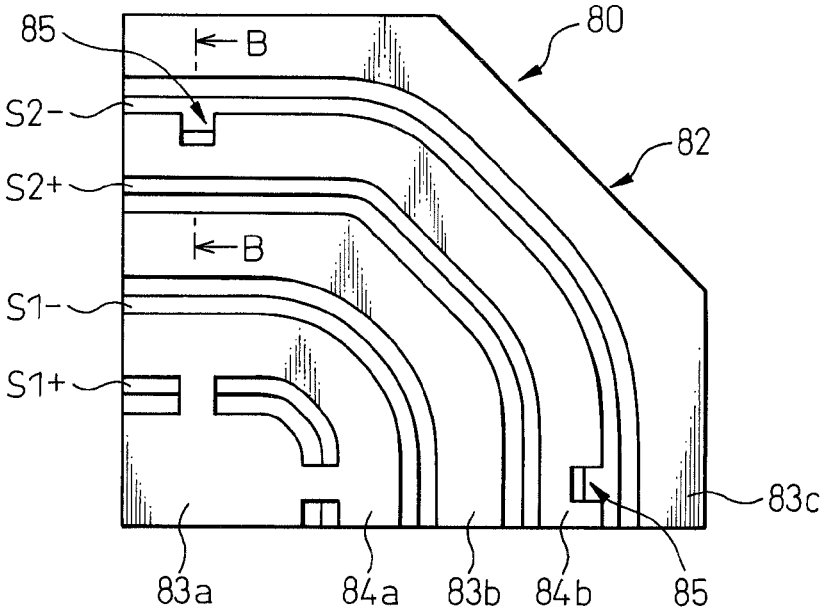
FIG. 12 is a partial side view of the connector structure shown in FIG. 11.
Figure 13:
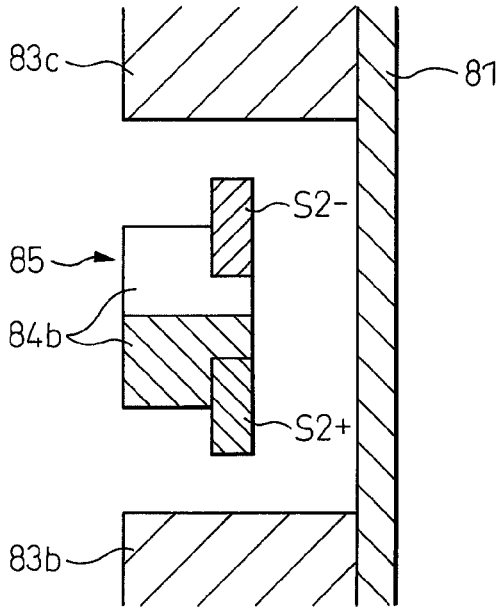
FIG. 13 is a partial enlarged cross-sectional view along the line B-B of FIG. 12 of the connector structure shown in FIG. 11.

FIG. 11 is a partial perspective view of a connector structure 80 according to another aspect of the present invention, FIG. 12 is a partial side view of the connector structure 80 shown in FIG. 11, and FIG. 13 is a partial enlarged cross-sectional view along the line B-B of FIG. 12 of the connector structure 80 shown in FIG. 11. The connector structure 80 has an insulator board 81 and an insulator body 82. The body 82 has partitions 83*a*, 83*b*, and 83*c* which are attached to the board 81 and contact support members 84*a* and 84*b*. The contact support members 84*a* and 84*b* are attached to the partitions by not shown parts and support the pairs of the signal contacts S1+ and S1− and S2+ and S2− so that they do not contact the board 81. Further, the signal contacts S1+ and S1− and S2+ and S2− are separated by the contact support members 84*a* and 84*b* so that the signal contacts of each pair do not contact each other. Note that, the signal contacts S1+ and S1− and S2+ and S2− are exposed at parts other than parts which contact the contact support members 84*a* and 84*b*.

In the present aspect, parts of contact support member 84*b* are cut away to form recesses 85 at the side facing the signal contact, of the pair of signal contacts S2+ and S2− separated by the contact support member 84*b*, with the longer transmission line length, that is, the signal contact S2− side. For example, if making the insulator material of the contact support member 84*b* polyethylene, the relative permittivity of polyethylene is about 2.3, while the relative permittivity of the part exposed by the recesses 85, that is, the air, is about 1. Therefore, the relative permittivity of air is smaller than the relative permittivity of polyethylene. Therefore, according to the above formula (1), by making the relative permittivity smaller, the speed Vp becomes larger. As a result, it becomes possible to adjust a signal to be transmitted simultaneously with the signal contact S2+ side with the short transmission line length.

Note that, the suitable ranges and sizes of the recesses 85 are determined by experiment or calculations. The bridge part which is provided at the contact support member 84*a* will be explained in the next aspect.

Figure 14:
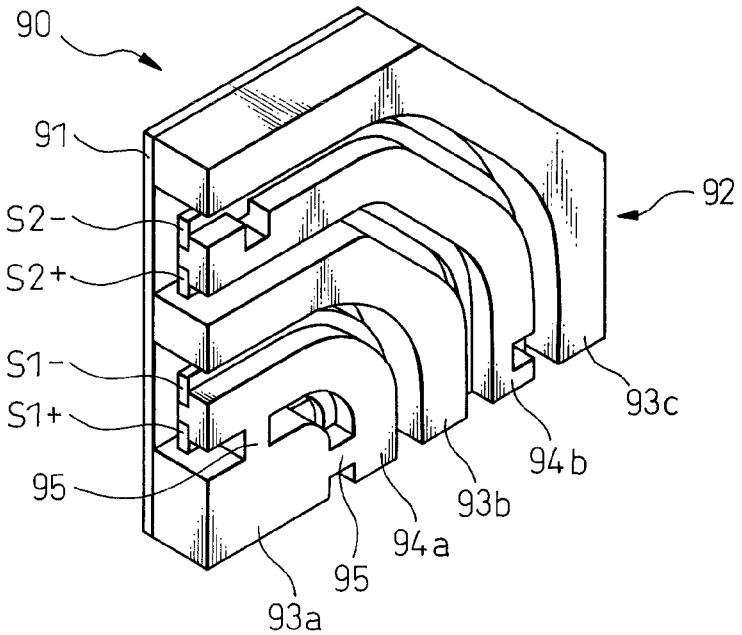
FIG. 14 is a partial perspective view of a connector structure according to still another aspect of the present invention.
Figure 15:
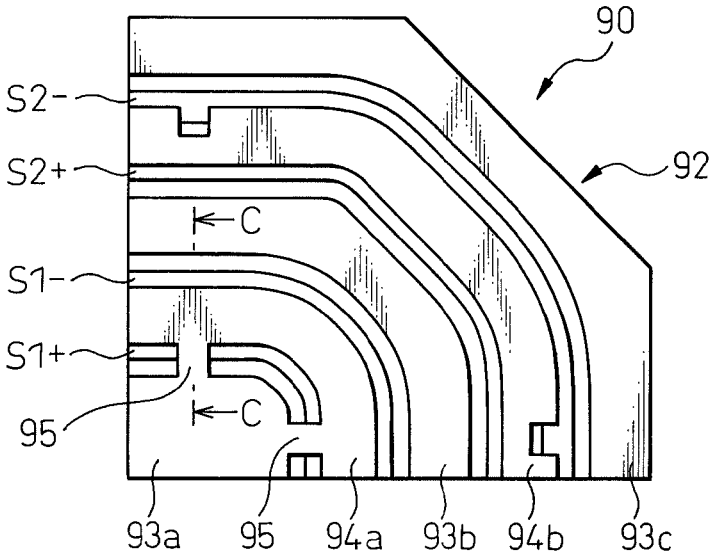
FIG. 15 is a partial side view of the connector structure shown in FIG. 14.
Figure 16:
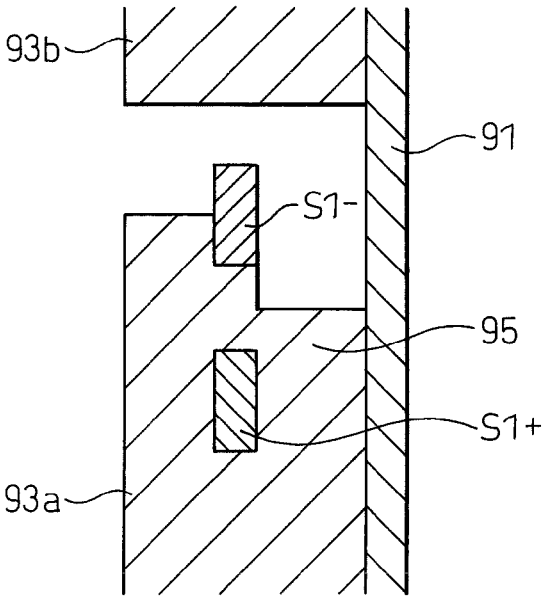
FIG. 16 is a partial enlarged cross-sectional view along the line C-C of FIG. 15 of the connector structure shown in FIG. 14.

FIG. 14 is a partial perspective view of a connector structure 90 according to still another aspect of the present invention, FIG. 15 is a partial side view of the connector structure shown 90 in FIG. 14, and FIG. 16 is a partial enlarged cross-sectional view along the line C-C of FIG. 15 of the connector structure 90 shown in FIG. 14. The connector structure 90 has an insulator board 91 and an insulator body 92. The body 92 has partitions 93*a*, 93*b*, and 93*c* which are attached to the board 91 and has contact support members 94*a* and 94*b*. The contact support members 94*a* and 94*b* are attached to the partitions by not shown parts and support the pairs of the signal contacts S1+ and S1− and S2+ and S2− so as not to contact the board 71. Further, the signal contacts S1+ and S1− and S2+ and S2− are separated by the contact support members 94*a* and 94*b* so the signal contacts of each pair do not contact each other. Note that, the signal contacts S1+ and S1− and S2+ and S2− are exposed at parts other than those contacting the contact support members 94*a* and 94*b*.

In the present aspect, a bridge part 95 is provided which bridges the contact support member 94*a* at the side facing the signal contact, of the pair of signal contacts S1+ and S1− separated by the contact support member 94*a*, with the shorter transmission line length, that is, the signal contact S1+ side, and the partition 93*a*. The bridge part 95, as shown by the cross-sectional view of FIG. 16, covers all of the signal contact S1+, so the part which was previously exposed to the air is now covered by an insulator. The relative permittivity of the bridge part 95 is, as explained above, larger than the relative permittivity of air. Therefore, according to the above formula (1), by making the relative permittivity larger, the speed Vp becomes smaller and as a result it becomes possible to adjust a signal to be transmitted at the same time as with the signal contact S1− side with the long transmission line length.

Note that, the suitable range and size of the bridge part 95 are determined by experiments or calculations.

Only naturally, the aspects of the present invention shown in FIGS. 8 to 16 may be used combined.

The above aspects of the present invention were all explained with reference to a connector for balanced transmission, but the invention can also be applied to an application which transmits signals other than differential signals to a plurality of, such as four or eight, signal contacts and simultaneously receives them.

Note that, the present invention was explained in detail based on specific embodiments, but a person skilled in the art could make various changes, modifications, etc. without departing from the claims and concept of the present invention.

REFERENCE SIGNS LIST

10 connector
11 signal contact
12*a* connecting part
12*b* connecting part
13 first holding member
14 second holding member

The invention claimed is:

1. A connector comprising:

a pair of signal contacts that form balanced transmission lines, each of said signal contacts of said pair being spaced apart from each other and including a first connecting part provided at one end of the signal contact and a second connecting part provided at another end of the signal contact;

a first holding member made of insulating material, which holds the first connecting part of each of the signal contacts;

a second holding member made of insulating material, which is unconnected to the first holding member and which holds the second connecting part of each of the signal contacts; and a ground contact which has a shield body arranged in parallel with said pair of signal contacts and a shield member provided at one end edge of said shield body, wherein the shield member passes through said first holding member or second holding member and is arranged between the first connecting part or the second connecting part and intermediate parts of said pair of signal contacts between said first holding member and said second holding member are exposed to air without being covered with the insulating material.

2. A connector as set forth in claim 1, further comprising a fastening member which fastens said intermediate parts of said pair of signal contacts.

3. A connector as set forth in claim 2, wherein each of said first holding member, said second holding member, and said fastening member are formed together with said pair of signal contacts by insert molding.

4. A connector comprising:

a pair of signal contacts that form balanced transmission lines, each of said signal contacts of said pair being spaced apart from each other and including a first connecting part provided at one end of the signal contact and a second connecting part provided at another end of the signal contact;

a first holding member made of insulating material, which holds the first connecting part of each of the signal contacts;

a second holding member made of insulating material, which is unconnected to the first holding member and which holds the second connecting part of each of the signal contacts, wherein intermediate parts of said pair of signal contacts between said first holding member and said second holding member are exposed to air without being covered with the insulating material, and the first holding member and the second holding member are positioned such that a direction in which the first connecting part extends from the first holding member is perpendicular to a direction in which the second contacting part extends from the second holding member.

* * * * *